United States Patent [19]

Pollitz

[11] Patent Number: 4,601,403

[45] Date of Patent: Jul. 22, 1986

[54] CONTAINER WITH INVERTIBLE LID

[75] Inventor: Hilda S. Pollitz, Riverside, Calif.

[73] Assignee: Teleflora Corporation, Los Angeles, Calif.

[21] Appl. No.: 646,973

[22] Filed: Sep. 4, 1984

[51] Int. Cl.[4] ..... B65D 51/28

[52] U.S. Cl. ..... 215/228; 220/23; 220/352

[58] Field of Search ..... 220/23, 287, 352; 215/228

[56] References Cited

U.S. PATENT DOCUMENTS

| | | | |
|---|---|---|---|
| 653,262 | 7/1900 | Rodiger | 215/228 |
| 2,732,119 | 1/1956 | Risch | 220/23 |
| 2,813,651 | 11/1957 | Schlumbohm . | |
| 2,827,194 | 3/1958 | Matton | 215/228 |
| 3,405,832 | 10/1968 | Lukesch et al. . | |
| 3,537,610 | 11/1970 | Bilon | 220/23 |
| 3,624,789 | 11/1971 | Peryser | 220/287 |

*Primary Examiner*—George E. Lowrance

*Attorney, Agent, or Firm*—Pretty, Schroeder, Brueggemann & Clark

[57] ABSTRACT

A container having an open upper end, combined with a mating lid that can be inserted into the container's open upper end in either of two alternative orientations. In one orientation, a recess in the lid faces upwardly such that the lid can support a floral arrangement. In an inverted orientation, a closed end of the lid faces upwardly such that the lid has a decorative shape that harmonizes with that of the container.

2 Claims, 2 Drawing Figures

CONTAINER WITH INVERTIBLE LID

BACKGROUND OF THE INVENTION

This invention relates generally to floral containers, and, more particularly, to floral containers having associated, mating lids.

It has recently become popular among florists to sell floral arrangements in containers that continue to have usefulness after the arrangements are no longer fresh and have been discarded. Many such containers, including coffee pots, water carafes, and the like, have lids associated with them. When the florist sells such a container and floral arrangement, it is desirable for the lid to be integrated into the combination in a convenient fashion, without detracting from its appearance.

It should therefore be appreciated that there is a need for a special lid configuration that can be used in combination with a mating container to carry and display a floral arrangement or, alternatively, to provide a decorative cover for the container.

SUMMARY OF THE INVENTION

The present invention is embodied in an improved container and mating lid, in which the lid can be selectively inserted into the container's open upper end in two alternative orientations. In one orientation, a recess in the lid serves as a receptacle for a floral arrangement, and an inverted orientation it serves as a decorative cover for the container. In accordance with the invention, the lid has a generally cup-like shape, with an open end, a closed end, and a side wall located between the two ends, and the lid further includes a rim projecting outwardly from the side wall. The rim is sized to engage and be supported by a lip that defines the container's open upper end lip, and the lid can be selectively placed into the container's open upper end with either its open end or its closed end facing upwardly. In addition, the cup-like shape of the lid permits it to support a floral arrangement when it is inserted with its open end facing upwardly, and to provide a decorative appearance that harmonizes with that of the container when it is inserted with its closed end facing upwardly. In the preferred form of the invention, the side wall of the dual-purpose lid is generally cylindrical, and the rim extends completely around it.

The rim is preferably located approximately midway between the lid's upper end and closed end, such that when the lid is placed on the container in either orientation, approximately one-half of it projects above the container's open upper end.

Other aspects and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

The present invention is embodied in a container 11 such as a water carafe or the like in combination with a mating lid 13 that is insertable into the container's open upper end in either of two orientations. In one orientation, depicted in FIG. 1, the lid is adapted to carry a floral arrangement 15, while in an inverted orientation, depicted in FIG. 2, the lid provides a decorative appearance that harmonizes with that of the container. This special lid configuration is particularly advantageous in the florist industry, since it permits florists to sell the container and lid combination as a holder for a floral arrangement, and, after the floral arrangement has been discarded, the purchaser can use the combination as a useful, decorative item. Examples of such containers and mating lids that continue to have usefulness after the floral arrangements with which they are sold have been discarded include coffee pots, water carafes and the like.

Figure 1:
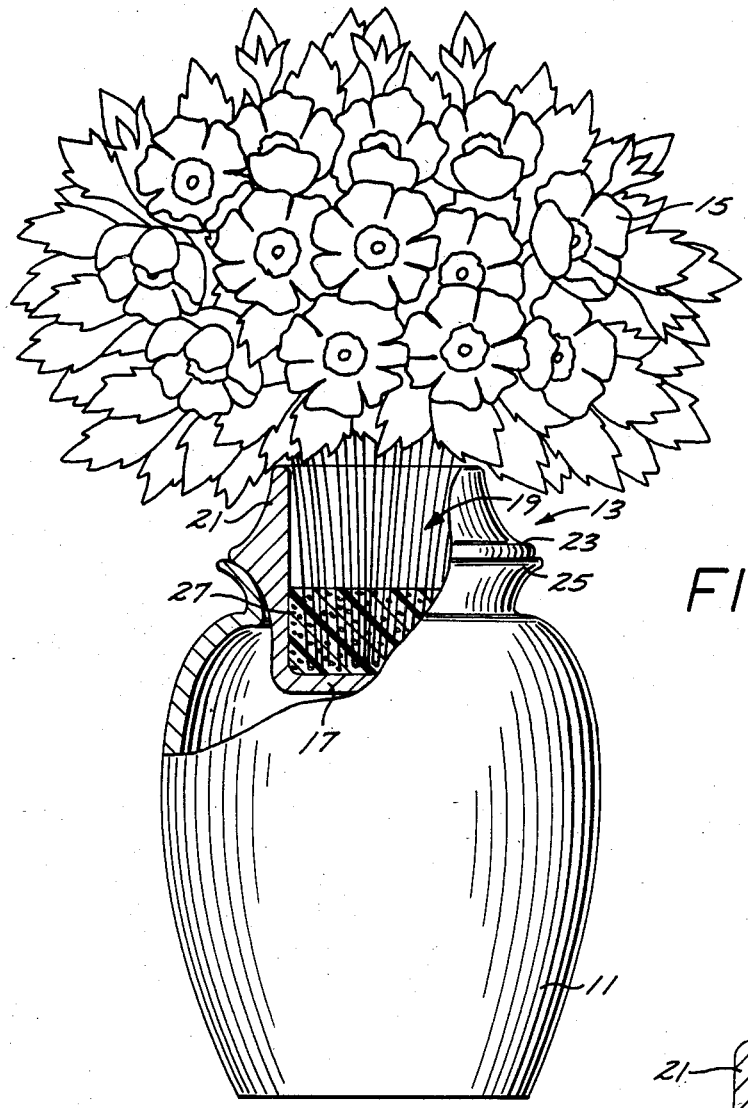
FIG. 1 is a side elevational view of a container and mating lid, the lid being oriented with its open end facing upwardly and carrying a floral arrangement, and a portion of the container and lid being broken away to reveal how the lid conformably seats on the container.
Figure 2:
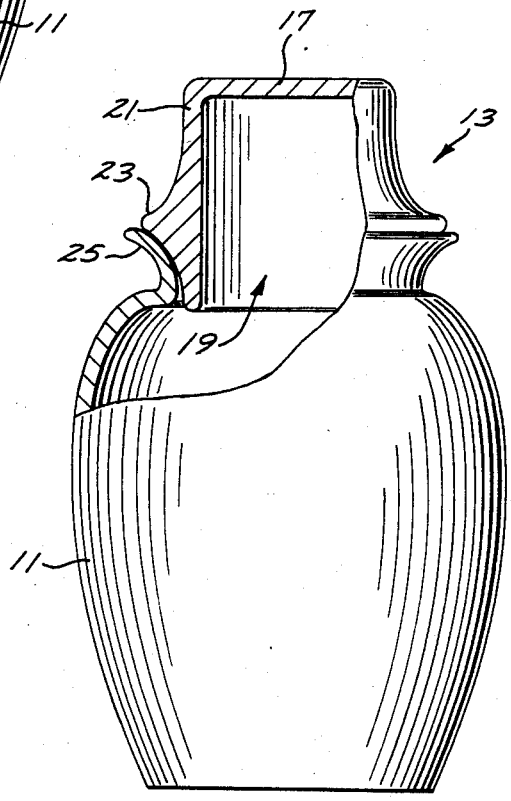
FIG. 2 is a side elevational view of the container and lid of FIG. 1, but with the floral arrangement removed and the lid oriented on the container with its closed end facing upwardly, a portion of the lid and container being broken away to reveal how the lid conformably seats on the container.

With particular reference to FIGS. 1 and 2, the lid 13 is shown to have a generally cup-like shape, with a closed end 17, an open end 19, and a generally cylindrical side wall 21 located between the two ends. An annular rim 23 projects outwardly from the side wall at its approximate midpoint, blending smoothly with the sidewall along its two edges.

A circular lip 25 on the container 11 defines the container's open upper end. The lip is sized to be slightly smaller than the rim 23 of the lid 13, and to have a shape that generally conforms with it. The lid can thereby be placed into the container's open upper end, with the rim resting on the lip in either of two orientations. In the orientation depicted in FIG. 1, the lid's open end 19 faces upwardly, whereas in the orientation depicted in FIG. 2, the lid's closed end 17 faces upwardly. In both cases, approximately one-half of the lid's side wall 21 is exposed above the container's lip.

In the configuration of FIG. 1, where the lid 13 is oriented with its open end 19 facing upwardly, the floral arrangement 15 is supported in the lid's hollow interior. A block of conventional floral foam 27 is preferably initially placed in the lid's interior, and the stems of the flowers are inserted into the foam to hold them in place. When the flowers have lost their freshness, they can be discarded along with the foam.

In FIG. 2, the lid 13 is placed on the container 11 with its closed end 17 facing upwardly. The exposed portion of the lid has a decorative appearance that harmonizes with that of the container.

The container 11 and lid 13 can be formed of any suitable material, such as fired pottery or formed sheet metal.

It should be appreciated from the foregoing description that the present invention provides an improved container and mating lid, in which the lid can be selectively placed in the container's open upper end in either of two orientations. In one orientation, a recess in the lid is presented upwardly such that it can support a floral arrangement, whereas in an inverted orientation, the lid provides a decorative shape that harmonizes with that of the container.

Although the present invention has been described in detail with reference to the presently preferred embodiment, it will be appreciated by those of ordinary skill in the art that various modifications can be made without departing from the invention. Accordingly, the invention is limited only by the following claims:

I claim:

1. In combination:

a container having a circular, flared lip that defines an open upper end, the lip having a substantially uniform vertical radius; and a cup-shaped lid having an open end, a closed end, a side wall located between the two ends, and a circular rim projecting outwardly from the side wall, approximately midway between the lid's open end and closed end, the lid being selectively placeable in the open upper end of the container in either of two orientations, one orientation with the open end facing upwardly and with the circular rim of the lid conformably engaging the circular, flared lip of the container, to seal the container's interior, and the other orientation with the closed end facing upwardly and with the circular rim of the lid conformably engaging the circular, flared lip of the container, to seal the container's interior, wherein when the open end of the lid faces upwardly, the lid is adapted to hold a floral arrangement, and wherein when the closed end of the lid faces upwardly, the lid provides a decorative appearance, wherein the side wall is substantially cylindrical, with a uniform inner surface and with a height at least as large as its diameter, wherein the closed end is defined by a flat wall of uniform thickness and substantially peripendicular to the cylindrical side wall such that the lid can be supported on a level surface with its open end facing upwardly, and wherein the outwardly-projecting circular rim is defined by a first vertically-curved surface having a uniform vertical radius substantially equal to the uniform vertical radius of the container's lip and blending smoothly with the portion of the side wall adjacent to the open end and further defined by a vertically-curved second surface having a uniform vertical radius substantially equal to the uniform vertical radius of the container's lip and blending smoothly with the portion of the side wall adjacent to the closed end, whereby the lid conformably rests in the container's open upper end in either of its two orientations.

2. A combination as defined in claim 1, and further including:

a block of floral foam located within the lid; and an arrangement of flowers disposed with the stems of the flowers projecting into, and supported by, the block of floral foam.

* * * * *